US010957271B2

(12) United States Patent
Park et al.

(10) Patent No.: US 10,957,271 B2
(45) Date of Patent: Mar. 23, 2021

(54) DISPLAY DEVICE AND DRIVING METHOD THEREOF

(71) Applicant: SAMSUNG DISPLAY CO., LTD., Yongin-si (KR)

(72) Inventors: Suk Jin Park, Yongin-si (KR); Yoon Gu Kim, Yongin-si (KR); Jae Hyoung Park, Yongin-si (KR); Akihiro Takegama, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/372,760

(22) Filed: Apr. 2, 2019

(65) Prior Publication Data

US 2019/0392776 A1 Dec. 26, 2019

(30) Foreign Application Priority Data

Jun. 21, 2018 (KR) ..... 10-2018-0071524

(51) Int. Cl.
*G09G 3/36* (2006.01)

(52) U.S. Cl.
CPC ..... *G09G 3/3685* (2013.01); *G09G 3/3696* (2013.01); *G09G 2310/0248* (2013.01)

(58) Field of Classification Search
CPC ..... G09G 3/3685; G09G 3/3696; G09G 2310/0248; G09G 2320/0223; G09G 3/20; G09G 2320/0285; G09G 2310/0281
See application file for complete search history.

(56) References Cited

U.S. PATENT DOCUMENTS

| | | | | |
|---|---|---|---|---|
| 7,095,393 | B2 * | 8/2006 | Lee | G09G 3/3648 345/204 |
| 9,171,511 | B2 * | 10/2015 | Park | G09G 3/3614 |
| 9,336,742 | B2 * | 5/2016 | Ahn | G09G 3/3659 |
| 9,396,694 | B2 * | 7/2016 | Ahn | G09G 3/3614 |
| 2006/0044241 | A1 * | 3/2006 | Yuh-Ren | G09G 3/3648 345/89 |
| 2007/0070085 | A1 * | 3/2007 | Yamagata | G09G 3/20 345/606 |
| 2015/0022512 | A1 * | 1/2015 | Ahn | G09G 3/3659 345/212 |
| 2015/0194119 | A1 * | 7/2015 | Ahn | G09G 3/3696 345/213 |

FOREIGN PATENT DOCUMENTS

KR 1020150010844 A 1/2015

* cited by examiner

*Primary Examiner* — Carolyn R Edwards
(74) *Attorney, Agent, or Firm* — Cantor Colburn LLP

(57) ABSTRACT

A display device includes a first data driver which is disposed at an upper side of a display panel and supplies a data signal to data lines of a plurality of data lines, a second data driver which is disposed at a lower side of the display panel and supplies a data signal to remaining data lines of the plurality of data lines, and a signal controller which outputs a corrected image signal, based on a first lookup table which stores a correction value of a first input image signal for the first data driver and a second lookup table which stores a correction value of a second input image signal for the second data driver.

20 Claims, 5 Drawing Sheets

DISPLAY DEVICE AND DRIVING METHOD THEREOF

The application claims priority to Korean patent application 10-2018-0071524 filed on Jun. 21, 2018, and all the benefits accruing therefrom under 35 U.S.C. § 119, the content of which in its entirety is herein incorporated by reference.

BACKGROUND

1. Field

Exemplary embodiments of the invention generally relate to a display device and a driving method thereof, and more particularly, to a display device capable of uniformly compensating for a charging rate in a dual bank structure and a driving method of the display device.

2. Description of the Related Art

Recently, a resolution of display devices has gradually increased, for example, from full high definition ("FHD") resolution of 1920×1080 pixels to 8 K ultra high definition ("UHD") resolution of 7680×4320 pixels or 4 K UHD resolution of 3840×2160 pixels. In a UHD display device, a number of data lines increases, and as a result, a number of data drivers increases. Therefore, an attachment region of a display panel is narrowed, and a difficulty occurs in a manufacturing process. In addition, as the number of data lines increases, current increases, and heat generation also increases. Accordingly, a display device having a structure in which data drivers are alternately attached to both upper and lower sides of the display panel has been proposed.

SUMMARY

In general, a charging time of a pixel region of the display panel, which is disposed distant from a data driver, is insufficient due to a voltage drop and a delay in a data line. Therefore, a charging ratio of the pixel region of the display panel, which is disposed distant from the data driver, is decreased, and the pixel region of the display panel, which is disposed distant from the data driver, is darker than a pixel region of the display panel, which is disposed close to the data driver. Such a luminance difference is recognized as a spot, and therefore, the display quality of an image is deteriorated.

In particular, in a dual bank structure in which data drivers are provided at both upper and lower sides of a display panel, a spot phenomenon may become more serious due to a difference in charging voltage between data lines driven by an upper data driver and a lower data driver.

Exemplary embodiments provide a display device capable of uniformly compensating for a charging rate of a display panel in a dual bank structure and a driving method of the display device.

Exemplary embodiments provide a display device capable of compensating for a charging rate by lookup tables with respect to an upper data driver and a lower data driver in a display panel having a dual bank structure, and a driving method of the display device.

According to an exemplary embodiment of the invention, there is provided a display device including a first data driver which is disposed at an upper side of a display panel and supplies a data signal to data lines of a plurality of data lines, a second data driver which is disposed at a lower side of the display panel and supplies a data signal to remaining data lines of the plurality of data lines, and a signal controller which outputs a corrected image signal, based on a first lookup table which stores a correction value of a first input image signal for the first data driver and a second lookup table which stores a correction value of a second input image signal for the second data driver.

In an exemplary embodiment, the signal controller may generate the corrected image signal with respect to the first input image signal for the first data driver, based on the first lookup table, and generate the corrected image signal with respect to the second input image signal for the second data driver, based on the second lookup table.

In an exemplary embodiment, the first lookup table may include a plurality of first sub-lookup tables, and the second lookup table may include a plurality of second sub-lookup tables.

In an exemplary embodiment, the display panel may be divided into N regions where N is a natural number. The plurality of first sub-lookup tables and the plurality of second sub-lookup tables may correspond to at least one of the N divided region of the display panel.

In an exemplary embodiment, the signal controller may generate the corrected image signal with respect to the first input image signal with reference to a first sub-lookup table corresponding to a region to which a pixel to display the first input image signal belongs, and generate the corrected image signal with respect to the second input image signal with reference to a second sub-lookup table corresponding to a region to which a pixel to display the second input image signal belongs.

In an exemplary embodiment, the display device may further include pixels including a plurality of sub-pixels which is coupled to the data lines and displays images of different colors. The plurality of first sub-lookup tables and the plurality of second sub-lookup tables may respectively correspond to the plurality of sub-pixels.

In an exemplary embodiment, the signal controller may output the corrected image signal, further based on a third lookup table which stores a coefficient value applied to correction values of the first lookup table and the second lookup table.

In an exemplary embodiment, the signal controller may generate the corrected image signal with respect to the first input image signal by multiplying the coefficient value by the correction value of the first lookup table, and generate the corrected image signal with respect to the second input image signal by multiplying the coefficient value by the correction value of the second lookup table.

In an exemplary embodiment, the display panel may be divided into N regions where N is a natural number. The third lookup table may store a plurality of coefficient values respectively corresponding to the N regions.

In an exemplary embodiment, the signal controller may transfer data generated based on the corrected image signal to the first data driver and the second data driver. The first data driver and the second data driver may transfer a data voltage corresponding to the data as the data signal to the data lines.

According to an exemplary embodiment of the invention, there is provided a method for driving a display device including a first data driver disposed at an upper side of a display panel to supply a data signal to data lines of a plurality of data lines, a second data driver disposed at a lower side of the display panel to supply a data signal to remaining data lines of the plurality of data lines, and a signal controller for controlling the first data driver and the second data driver, the method including receiving, by the signal controller, a first input image signal for the first data driver and a second input image signal for the second data driver, and outputting a corrected image signal, based on a first lookup table for storing a correction value of a first input image signal for the first data driver and a second lookup table for storing a correction value of a second input image signal for the second data driver.

In an exemplary embodiment, the outputting the corrected image signal may include generating the corrected image signal with respect to the first input image signal for the first data driver, based on the first lookup table, and generating the corrected image signal with respect to the second input image signal for the second data driver, based on the second lookup table.

In an exemplary embodiment, the first lookup table may include a plurality of first sub-lookup tables, and the second lookup table may include a plurality of second sub-lookup tables.

In an exemplary embodiment, the display panel may be divided into N regions where N is a natural number. The plurality of first sub-lookup tables and the plurality of second sub-lookup tables may correspond to at least one of the N divided region of the display panel.

In an exemplary embodiment, the outputting the corrected image signal may include generating the corrected image signal with respect to the first input image signal with reference to a first sub-lookup table corresponding to a region to which a pixel to display the first input image signal belongs, and generating the corrected image signal with respect to the second input image signal with reference to a second sub-lookup table corresponding to a region to which a pixel to display the second input image signal belongs.

In an exemplary embodiment, the display device may further include pixels including a plurality of sub-pixels coupled to the data lines, the plurality of sub-pixels displaying images of different colors. The plurality of first sub-lookup tables and the plurality of second sub-lookup tables may respectively correspond to the plurality of sub-pixels.

In an exemplary embodiment, the corrected image signal may be output further based on a third lookup table for storing a coefficient value applied to correction values of the first lookup table and the second lookup table.

In an exemplary embodiment, the outputting the corrected image signal may include generating the corrected image signal with respect to the first input image signal by multiplying the coefficient value by the correction value of the first lookup table, and generating the corrected image signal with respect to the second input image signal by multiplying the coefficient value by the correction value of the second lookup table.

In an exemplary embodiment, the display panel may be divided into N regions where N is a natural number. The third lookup table may store a plurality of coefficient values respectively corresponding to the N regions.

In an exemplary embodiment, the method may further include transferring data generated based on the corrected image signal to the first data driver and the second data driver. The first data driver and the second data driver may transfer a data voltage corresponding to the data as the data signal to the data lines.

BRIEF DESCRIPTION OF THE DRAWINGS

Exemplary embodiments will now be described more fully hereinafter with reference to the accompanying drawings, in which.

DETAILED DESCRIPTION

Figure 1:
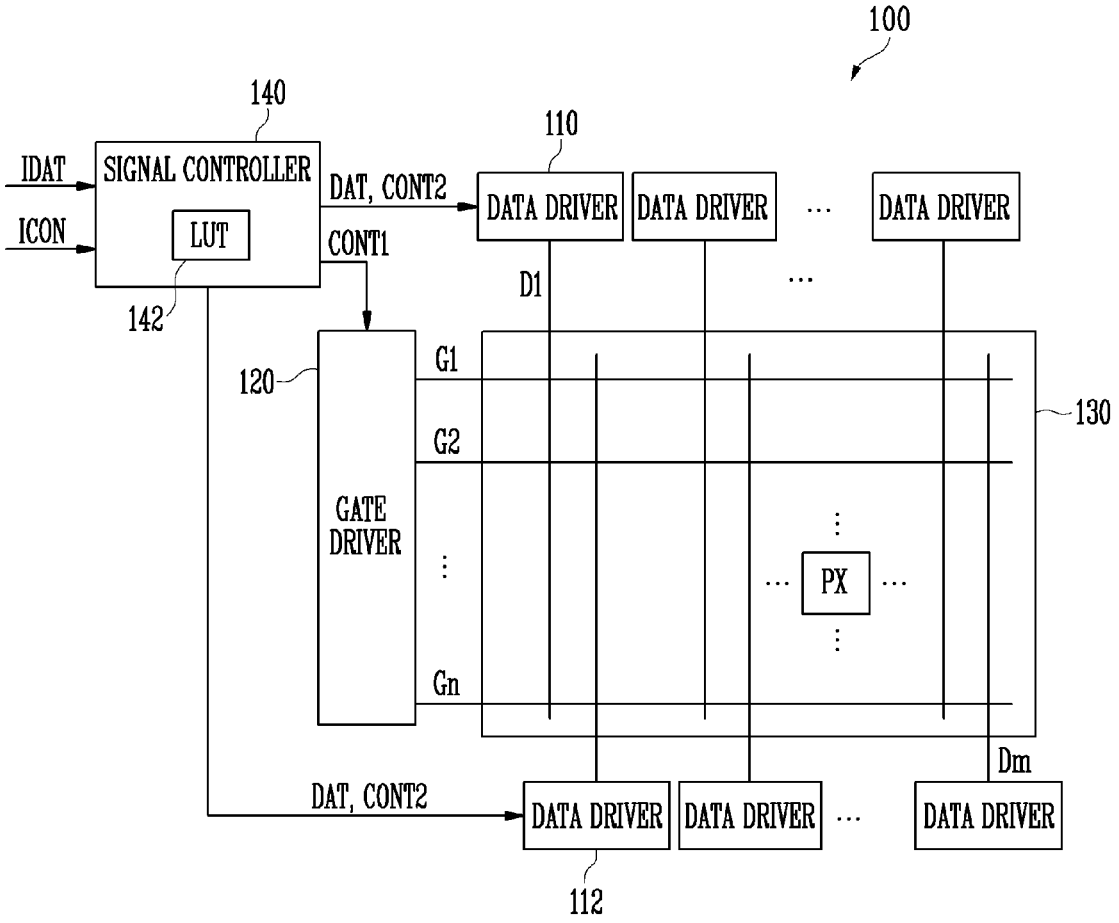
FIG. 1 is a block diagram schematically illustrating an exemplary embodiment of a display device according to the invention.

The advantages and features of the invention, and the way of attaining them, will become apparent with reference to embodiments described below in conjunction with the accompanying drawings. However, the invention is not limited to the exemplary embodiments but may be implemented into different forms. These embodiments are provided only for illustrative purposes and for full understanding of the scope of the invention by those skilled in the art. In the entire specification, when an element is referred to as being "connected" or "coupled" to another element, it can be directly connected or coupled to the another element or be indirectly connected or coupled to the another element with one or more intervening elements interposed therebetween. It should note that in giving reference numerals to elements of each drawing, like reference numerals refer to like elements even though like elements are shown in different drawings.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

In the drawing figures, dimensions may be exaggerated for clarity of illustration. It will be understood that when an element is referred to as being "between" two elements, it may be the only element between the two elements, or one or more intervening elements may also be present. Like reference numerals refer to like elements throughout.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, a display device and a driving method thereof will be described with reference to exemplary embodiments in conjunction with the accompanying drawings.

Figure 2:
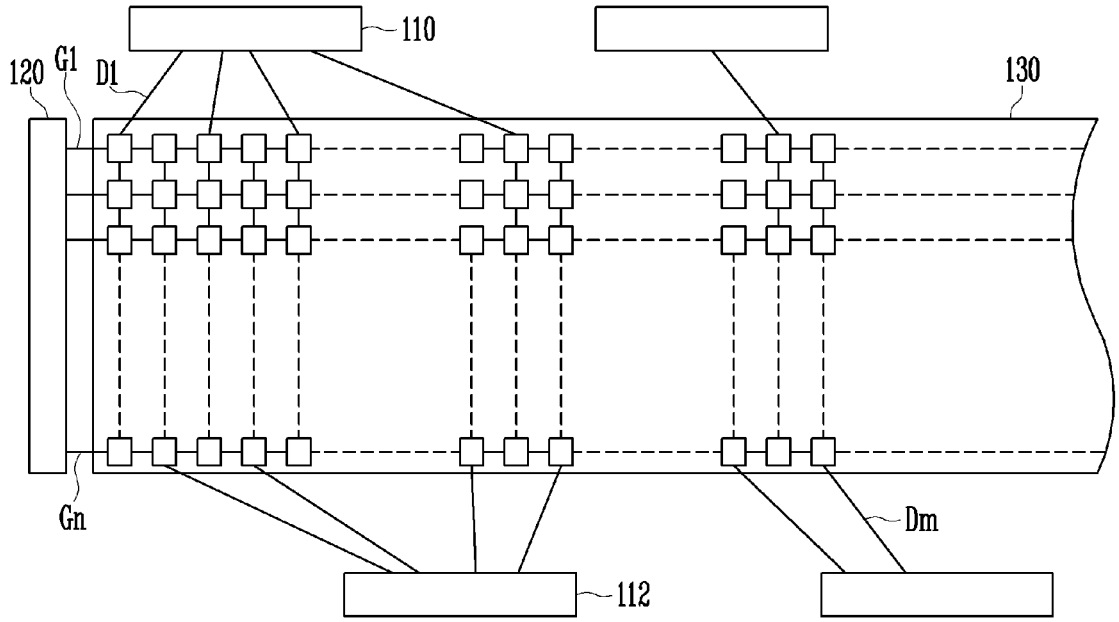
FIG. 2 is a block diagram illustrating an exemplary embodiment of data lines of the display device according to the invention.

FIG. 1 is a block diagram schematically illustrating an exemplary embodiment of a display device according to the invention. FIG. 2 is a block diagram illustrating an exemplary embodiment of data lines of the display device according to the invention.

Referring to FIG. 1, the display device 100 according to the invention includes first and second data drivers 110 and 112 for outputting data signals to a plurality of data lines D1 to Dm where m is a natural number, a gate driver 120 for providing gate signals to a plurality of gate lines G1 to Gn where n is a natural number, and a display panel 130 for displaying an image, using the data signals and the gate signals. The display device 100 further includes a signal controller 140 for controlling the first and second data drivers 110 and 112 and the gate driver 120.

The first and second data drivers 110 and 112 may be provided in the form of an integrated circuit ("IC") disposed on a flexible printed circuit board ("FPCB") (not shown) attached to the display panel 130.

The first and second data drivers 110 and 112 receive a data control signal CONT2 and data DAT from the signal controller 140 and selects a gray scale voltage corresponding to each of the data DAT, thereby generating the data DAT as a data voltage that is an analog data signal. The data DAT is a digital signal and has a predetermined number of values (or gray scales). The data control signal CONT2 includes a horizontal synchronization start signal for notifying that the transmission of data DAT to pixels PX on one row has been started, at least one data load signal for applying a data voltage to data lines D1 to Dm, a data clock signal, and the like. The data control signal CONT2 may further include an inversion signal for inverting the polarity of a data voltage with respect to a common voltage. The first and second data drivers 110 and 112 are coupled to the data lines D1 to Dm of the display panel 130 to apply a data voltage to a corresponding data line among the data lines D1 to Dm.

In various exemplary embodiments of the invention, the first and second data drivers 110 and 112 are disposed at both upper and lower sides of the display panel 130. A first data driver 110 disposed at the upper side of the display panel 130 may be referred to as an upper data driver, and a second data driver 112 disposed at the lower side of the display panel 130 may be referred to as a lower data driver. The first data driver 110 disposed at the upper side of the display panel 130 may be at least one driver IC for applying a data voltage to some of the data lines D1 to Dm at upper sides of the some of the data lines D1 to Dm, and the second data driver 112 disposed at the lower side of the display panel 130 may be at least one driver IC for applying a data voltage to the others of the data lines D1 to Dm at lower sides of the others of the data lines D1 to Dm. In an exemplary embodiment, data lines D2, D4, . . . , and Dm coupled to the second data driver 112 and data lines D1, D3, . . . , and Dm-1 coupled to the first data driver 110 are separated from each other, for example.

The gate driver 120 receives a gate control signal CONT1 from the signal controller 140, and generates a gate signal including a combination of a gate-on voltage at which a switching element of the pixel PX may be turned on and a gate-off voltage at which the switching element of the pixel PX may be turned off, in response to the gate control signal CONT1. The gate control signal CONT1 includes a scan start signal for indicating scan start, at least one gate clock signal for controlling an output time of the gate-on voltage, and the like. The gate driver 120 is coupled to gate lines G1 to Gn of the display panel 130 to apply a gate signal to the gate lines G1 to Gn.

In exemplary embodiments, the display panel 130 may be a display panel included in various flat panel displays ("FPDs") such as a liquid crystal display ("LCD"), an organic light emitting display ("OLED"), and an electrowetting display ("EWD").

The display panel 130 includes a plurality of data lines D1 to Dm, a plurality of gate lines G1 to Gn, and a plurality of pixels PX coupled to the plurality of data lines D1 to Dm and the plurality of gate lines G1 to Gn. The gate lines G1 to Gn may transfer a gate signal, extend in an approximately row direction, and be substantially parallel to one another. The data lines D1 to Dm may extend in an approximately column direction and be substantially parallel to one another in the display panel 130.

Referring to FIG. 2, in various exemplary embodiments of the invention, the data lines D1 to Dm are coupled to one of the first data driver 110 and the second data driver 112, which are disposed at the upper and lower sides of the display panel 130. In an exemplary embodiment, as shown in FIG. 2, odd-numbered data lines among the data lines D1 to Dm may be coupled to the first data driver 110, and even-numbered data lines among the data lines D1 to Dm may be coupled to the second data driver 112. On the contrary, in another exemplary embodiment, the even-numbered data lines among the data lines D1 to Dm may be coupled to the first data driver 110, and the odd-numbered data lines among the data lines D1 to Dm may be coupled to the second data driver 112. In an alternative exemplary embodiment, the data lines D1 to Dm are coupled to one of the first data driver 110 and the second data driver 112 according to a specific sequence of numbers. In an alternative exemplary embodiment, the data lines D1 to Dm may be randomly (irregularly) coupled to the first data driver 110 and the second data driver 112. The coupling relationship between the first and second data drivers 110 and 112 and the data lines D1 to Dm may have various manners, and is not particularly limited thereto.

The plurality of pixels PX may be arranged in an approximately matrix form. Each pixel PX may be coupled to a corresponding data line among the data lines D1 to Dm and a corresponding gate line among the gate lines G1 to Gn. A switching element of the pixel PX may include at least one thin film transistor, and be turned on or turned off according to a gate signal transferred through the corresponding gate line to selectively transfer a data voltage transferred through the corresponding data line to a pixel electrode. The pixel PX may display an image with a corresponding luminance according to the data voltage applied to the pixel electrode.

The signal controller 140 receives an input image signal IDAT and an input control signal ICON for controlling display of the input image signal IDAT from an external graphic processor or the like. The signal controller 140 converts the input image signal IDAT into data DAT by appropriately processing the input image signal IDAT, based on the input image signal IDAT and the input control signal ICON. The signal controller 140 generates a gate control signal CONT1, a data control signal CONT2, and the like. The signal controller 140 outputs the gate control signal CONT1 to the gate driver 120, and outputs the data control signal CONT2 and the processed data DAT to the first and second data drivers 110 and 112.

The signal controller 140 may correct the input image signal IDAT. The signal controller 140 may generate a corrected image signal by correcting the input image signal IDAT according to the position of a pixel of the display panel 130, a previous input image signal of the same data line, an image pattern, etc.

To this end, the signal controller 140 may include a lookup table LUT 142 for storing compensation values of some gray scales or all gray scales of the input image data IDAT. The signal controller 140 may generate a corrected image signal by applying, to the input image signal IDAT, a correction value that is selected from the lookup table 142 or calculated corresponding to the input image signal IDAT. In an exemplary embodiment, the correction value may be selected from the lookup table 142 or calculated based on the position of a row to be charged with a data voltage, a current input image signal IDAT, and a previous input image signal, for example. In an exemplary embodiment, the signal controller 140 may generate a corrected image signal by adding a compensation value to the input image signal IDAT, for example. The signal controller 140 converts the corrected image signal into data DAT by processing the corrected image signal, and outputs the converted data DAT together with the data control signal CONT2 to the first and second data drivers 110 and 112.

The first data driver 110 and the second data driver 112 are disposed at different positions with respect to the display panel 130, and operate independently from each other. Hence, there may occur a difference in charging voltage between the data lines D1 to Dm driven by the first data driver 110 and the second data driver 112. When the same lookup table is used with respect to the first data driver 110 and the second data driver 112, a charging rate cannot be appropriately compensated. In the invention, there is proposed a method for compensating for an input image signal by applying different lookup tables respectively to the first data driver 110 and the second data driver 112.

Figure 3:
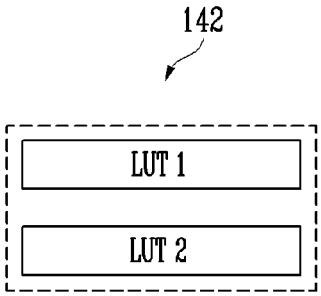
FIGS. 3 to 8 are diagrams illustrating exemplary embodiments of a lookup table for gray scale compensation according to the invention.

In an exemplary embodiment of the invention, the signal controller 140 includes at least two lookup tables LUT1 and LUT2 as shown in FIG. 3. A first lookup table LUT1 may correspond to the first data driver 110, and a second lookup table LUT2 may correspond to the second data driver 112. The first lookup table LUT1 and the second lookup table LUT2 may store different correction values according to the corresponding data drivers.

The signal controller 140 may generate a first corrected image signal with respect to an input image signal IDAT for the first data driver 110 with reference to the first lookup table LUT1, and generate a second corrected image signal with respect to an input image signal IDAT for the second data driver 112 with reference to the second lookup table LUT2.

Figure 4:
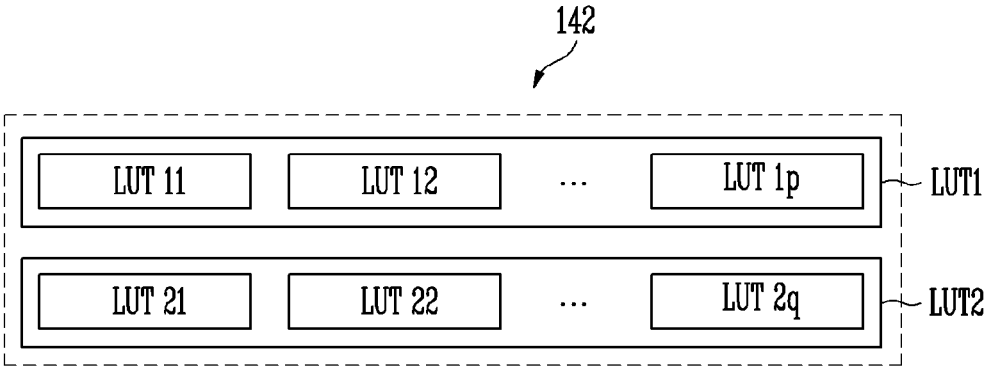

In an exemplary embodiment of the invention, when the display pane 130 is divided into N regions A1, . . . , and AN where N is a natural number, each of the lookup tables LUT1 and LUT2 may include a plurality of sub-lookup tables corresponding to at least one of the divided N regions A1, . . . , AN as shown in FIG. 4. In an exemplary embodiment, the first lookup table LUT1 may include p (p≤N) sub-lookup tables LUT11, LUT12, . . . , and LUT1*p*, and the second lookup table LUT2 may include q (q≤N) sub-lookup tables LUT21, LUT22, . . . , LUT2*q*, for example. The number p of sub-lookup tables of the first lookup table LUT1 and the number q of sub-lookup tables of the second lookup table LUT2 may be the same or different from each other.

Figure 5:
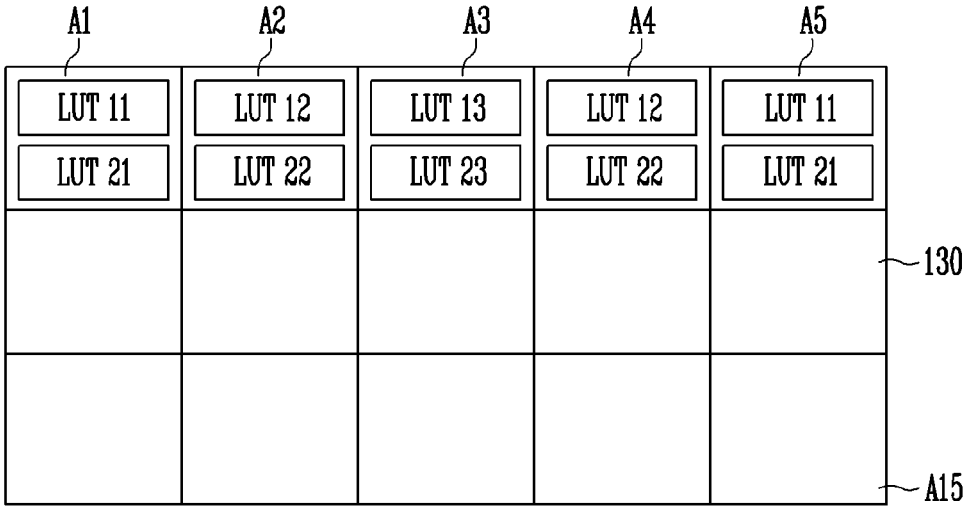

FIG. 5 illustrates an example of a case where the numbers p and q of sub-lookup tables is smaller than the number N of divided regions of the display panel 130 (i.e., p, q<N) according to the invention. In the example of FIG. 5, when the display panel 130 is divided into fifteen regions A1, . . . , and A15, the first lookup table LUT1 and the second lookup table LUT2 include sub-lookup tables of which a number is smaller than 15. Accordingly, at least some of the sub-lookup tables correspond to a plurality of divided regions. In an exemplary embodiment, a first sub-lookup table LUT11 of the first lookup table LUT1 and a first sub-lookup table LUT21 of the second lookup table LUT2 may correspond to a first region A1 and a fifth region A5 of the display panel 130, and a second sub-lookup table LUT12 of the first lookup table LUT1 and a second sub-lookup table LUT22 of the second lookup table LUT2 may correspond to a second region A2 and a fourth region A4 of the display panel 130, for example. A third sub-lookup table LUT13 of the first lookup table LUT1 and a third sub-lookup table LUT23 of the second lookup table LUT2 may correspond to only a third region A3 of the display panel 130. In this exemplary embodiment, a plurality of regions corresponding to one sub-lookup table may be set as regions having identical or similar charging rate change characteristics, which are determined in a manufacturing process of the display panel 130.

Figure 6:
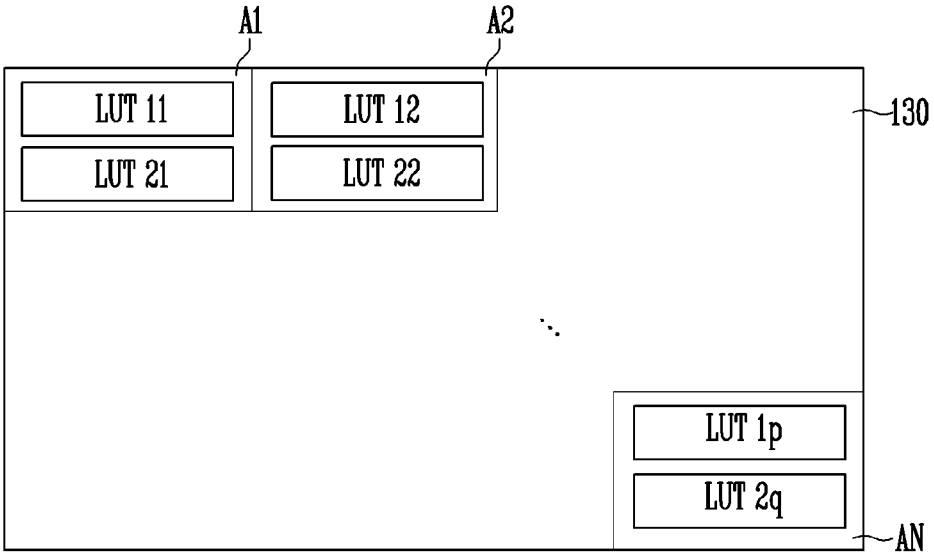

FIG. 6 illustrates an example of a case where the numbers p and q of sub-lookup tables is equal to the number N of divided regions of the display panel 130 (n, m=N) in according to the invention. In this example, sub-lookup tables correspond to the N divided regions A1, . . . , and AN of the display panel 130, respectively.

In an exemplary embodiment of the invention, the signal controller 140 may generate a corrected image signal with an input image signal IDAT for the first data driver 110 with reference to a sub-lookup table corresponding to a region to which a pixel PX to display the corresponding input image signal IDAT belongs among the plurality of sub-lookup tables constituting the first lookup table LUT1. Also, the signal controller 140 may generate a corrected image signal with an input image signal IDAT for the second data driver 112 with reference to a sub-lookup table corresponding to a region to which a pixel PX to display the corresponding input image signal IDAT belongs among the plurality of sub-lookup tables constituting the second lookup table LUT2.

Figure 7:
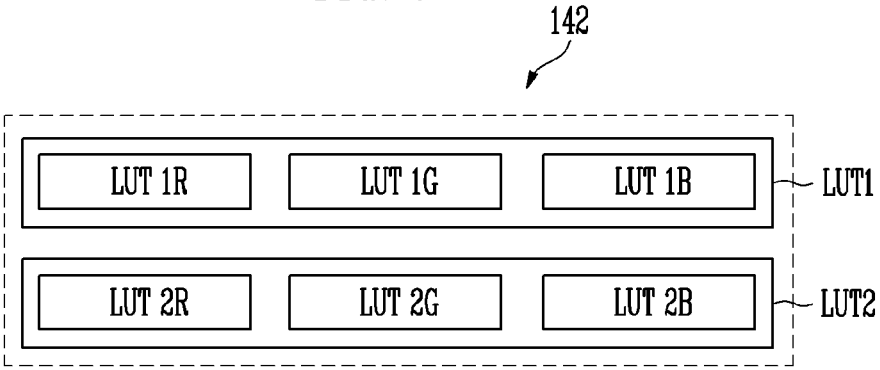

In an exemplary embodiment of the invention, when each pixel PX includes a plurality of sub-pixels, each of the lookup tables LUT1 and LUT2 may include at least one sub-lookup table corresponding to the respective sub-pixels. The sub-pixels may be, for example, three sub-pixels of R, G, and B. Each of the lookup tables LUT1 and LUT2 may include sub-lookup tables corresponding to the respective sub-pixels. In an exemplary embodiment, as shown in FIG. 7, the first lookup table LUT1 may include sub-lookup tables LUT 1R, LUT 1G, and LUT 1B corresponding to the respective sub-pixels, and the second lookup table LUT2 may include sub-lookup tables LUT 2R, LUT 2G, and LUT 2B corresponding to the respective sub-pixels, for example.

This exemplary embodiment may be applied such that, when sub-pixels are respectively coupled to different data drivers, a difference in charging rate between the sub-pixels may be more accurately compensated.

Figure 8:
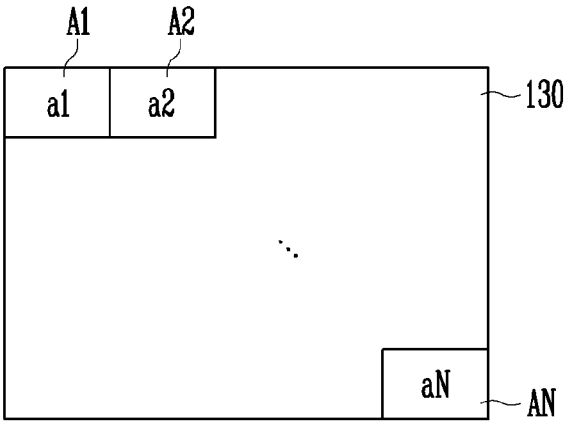

In an exemplary embodiment of the invention, the display panel 130 may be divided into N regions A1, . . . , and AN. The signal controller 140 may store coefficient values of the respective regions, using a separate lookup table, as shown in FIG. 8. The coefficient values (e.g., a1, a2. . . aN) are applied to compensation values of the lookup tables LUT1 and LUT2 in compensation of input image signals IDAT. In an exemplary embodiment, the coefficient values may be multiplied by the compensation values of the lookup tables LUT1 and LUT2 in the compensation of the input image signals IDAT, for example.

Specifically, the signal controller 140 may multiply a coefficient value of a pixel region in which an input image signal IDAT of the first data driver 110 is to be displayed by a compensation value of the first lookup table LUT1, and generate a corrected image signal, using the compensation value by which the coefficient value is multiplied. Also, the signal controller 140 may multiply a coefficient value of a pixel region in which an input image signal IDAT of the second data driver 112 is to be displayed by a compensation value of the second lookup table LUT2, and generate a corrected image signal, using the compensation value by which the coefficient value is multiplied. In an exemplary embodiment, the lookup table including the coefficient values may be stored in a register region separately from a memory region in which the first and second lookup tables LUT1 and LUT2 are stored.

Although the exemplary embodiments are separately described in the above, the technical spirit of the invention is not limited thereto, and the invention may be implemented by combining one or more exemplary embodiments.

As described above, in the invention, after an input image signal IDAT is corrected according to a compensation value determined based on the lookup tables LUT1 and LUT2 provided respectively corresponding to the upper data driver 110 and the lower data driver 112 (i.e., after a charging rate is compensated), the corrected image signal is converted into a voltage to be charged in a pixel PX, so that the charging rate may be uniformly compensated throughout the entire display panel 130. Thus, in the invention, an image quality failure such as a spot, which is caused by a difference in charging rate, may be removed in the display device 100 having a dual bank structure in which the first and second data drivers 110 and 112 are alternately disposed at upper and lower sides of the display panel.

Figure 9:
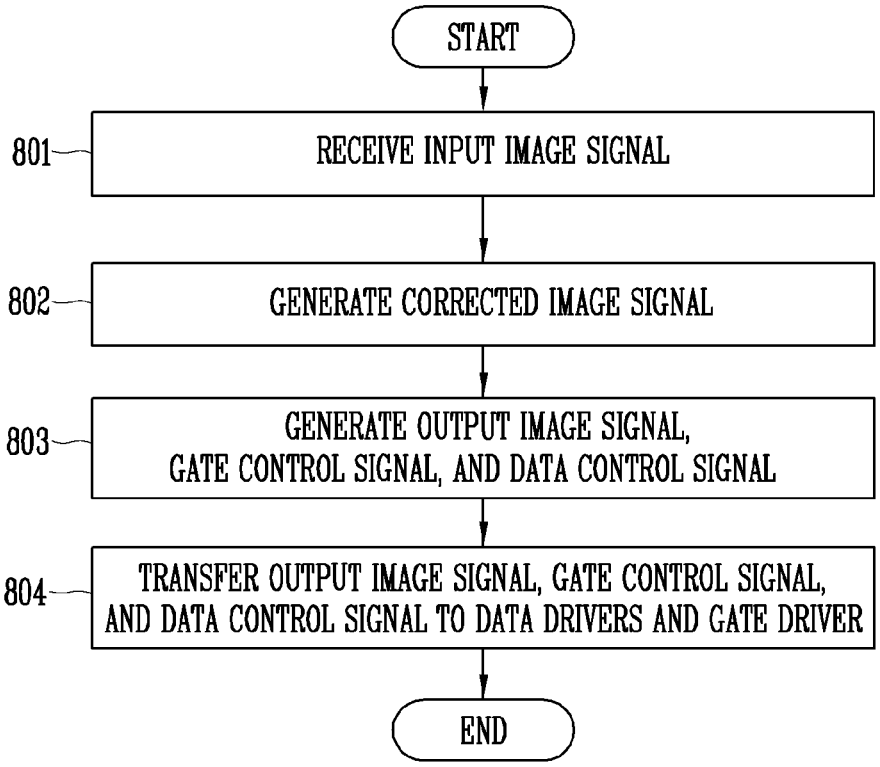
FIG. 9 is a flowchart illustrating an exemplary embodiment of a driving method of the display device according to the invention.

FIG. 9 is a flowchart illustrating a driving method of the display device according to the invention.

Referring to FIG. 9, first, the signal controller 140 of the display device 100 according to the invention receives an input image signal IDAT from an external graphic process or the like (801).

Next, the display device 100 generates a corrected image signal by processing the input image signal IDAT (802). The signal controller 140 of the display device 100 selects or calculates a correction value of the input image signal IDAT, based on the first lookup table LUT1 or the second lookup table LUT2, according to whether the input image signal IDAT corresponds to the first data driver 110 or whether the input image signal IDAT corresponds to the second data driver 112. In an exemplary embodiment, the corrected image signal may be obtained by adding a correction value to the input image signal, for example, but the invention is not limited thereto.

Next, the signal controller 140 of the display device 100 may convert the corrected image signal into data DAT by processing the corrected image signal, and generate a gate control signal CONT1 and a data control signal CONT2 (803).

Finally, the signal controller 140 of the display device 100 transfers the gate control signal CONT1 to the gate driver 120, and transfers the data control signal CONT2 and the data DAT to the first data driver 110 or the second data driver 112, thereby displaying an image (804).

The first and second data drivers 110 and 112 receive data DAT of pixels PX on one row and select gray scale voltages respectively corresponding to the data DAT in response to the data control signal CONT2 received from the signal controller 140. Therefore, the data DAT is converted into a data voltage that is an analog data signal, and the data voltage is applied to a corresponding data line among the data lines D1 to Dm.

The gate driver 120 turns on a switching element coupled to a corresponding gate line among the gate lines G1 to Gn by applying a gate-on voltage to gate lines G1 to Gn in response to the gate control signal CONT1 received from the signal controller 140. Accordingly, the data voltage applied to the corresponding data line is applied to a corresponding pixel PX through the turned-on switching element.

The difference between the data voltage applied to the pixel PX and the common voltage is represented as a pixel voltage. In the case of a liquid crystal display, the pixel voltage is a voltage charged in a liquid crystal capacitor, and the arrangement of liquid crystal molecules is changed depending on the magnitude of the pixel voltage. Accordingly, the polarization of light passing through a liquid crystal layer is changed. This change in polarization is represented as a change in transmittance of light by a polarizer attached to the liquid crystal display. Data signals are applied to all pixels PX by applying the gate-on voltage to all gate lines G1 to Gn, so that an image of one frame may be displayed.

As described above, in the invention, after an input image signal IDAT is corrected with reference to different lookup tables with respect to the first data driver 110 and the second data driver 112, which are respectively provided at different positions of the display panel 130, e.g., upper and lower sides of the display panel 130, the corrected input image signal is converted into a data voltage to be applied to a pixel PX. Thus, a difference in charging rate in the display panel 130 may be compensated, which is caused when the first data driver 110 and the second data driver 112 are separately driven.

In the display device and the driving method thereof according to the invention, the charging rate of the display panel is uniformly compensated in the display device having the dual bank structure. Accordingly, the occurrence of a spot may be prevented, and the display quality of an image may be improved.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other exemplary embodiments unless otherwise specifically indicated. Accordingly, it will be understood by those of skill in the art that various changes in form and details may be made without departing from the spirit and scope of the invention as set forth in the following claims.

What is claimed is:

1. A display device comprising:

pixels arranged in rows and columns in a display area of a display panel;

a first data driver which is disposed at an upper side of the display panel and supplies a data signal to first data lines of a plurality of data lines;

a second data driver which is disposed at a lower side of the display panel and supplies a data signal to second data lines of the plurality of data lines; and a signal controller which outputs a corrected image signal, based on a first lookup table which stores a first correction value of a first input image signal for the first data driver based on a location of the first data driver with respect to a position on the display panel and a second lookup table which stores a second correction value of a second input image signal for the second data driver based on a location of the second data driver with respect to a position on the display panel, wherein one of the rows includes first pixels connected to the first data lines and second pixels connected to the second data lines, the first pixels and the second pixels being connected to a same gate line to be simultaneously supplied with respective data signals, and wherein the first and second correction values are set to different values so as to compensate for a difference between a charging rate of the first data lines by the first data driver and a charging rate of the second data lines by the second data driver.

2. The display device of claim 1, wherein the signal controller generates the corrected image signal with respect to the first input image signal for the first data driver, based on the first lookup table, and generates the corrected image signal with respect to the second input image signal for the second data driver, based on the second lookup table.

3. The display device of claim 1, wherein the first lookup table includes a plurality of first sub-lookup tables, and the second lookup table includes a plurality of second sub-lookup tables.

4. The display device of claim 3, wherein the display panel is divided into N regions where N is a natural number, wherein the plurality of first sub-lookup tables and the plurality of second sub-lookup tables correspond to at least one of the N divided regions of the display panel.

5. The display device of claim 4, wherein the signal controller generates the corrected image signal with respect to the first input image signal with reference to a first sub-lookup table corresponding to a region to which a pixel to display the first input image signal belongs, and generates the corrected image signal with respect to the second input image signal with reference to a second sub-lookup table corresponding to a region to which a pixel to display the second input image signal belongs.

6. The display device of claim 3, wherein the pixels include a plurality of sub-pixels which is coupled to the plurality of data lines and displays images of different colors, and the plurality of first sub-lookup tables and the plurality of second sub-lookup tables respectively correspond to the plurality of sub-pixels.

7. The display device of claim 1, wherein the signal controller outputs the corrected image signal, further based on a third lookup table which stores a coefficient value applied to the first and second correction values of the first lookup table and the second lookup table.

8. The display device of claim 7, wherein the signal controller generates the corrected image signal with respect to the first input image signal by multiplying the coefficient value by the first correction value of the first lookup table, and generates the corrected image signal with respect to the second input image signal by multiplying the coefficient value by the second correction value of the second lookup table.

9. The display device of claim 7, wherein the display panel is divided into N regions where N is a natural number, wherein the third lookup table stores a plurality of coefficient values respectively corresponding to the N regions.

10. The display device of claim 1, wherein the signal controller transfers data generated based on the corrected image signal to the first data driver and the second data driver, wherein the first data driver and the second data driver transfer a data voltage corresponding to the data as the data signal to the plurality of data lines.

11. A method for driving a display device including a first data driver disposed at an upper side of a display panel to supply a data signal to first data lines of a plurality of data lines, a second data driver disposed at a lower side of the display panel to supply a data signal to second data lines of the plurality of data lines, and a signal controller for controlling the first data driver and the second data driver, the method comprising:

receiving, by the signal controller, a first input image signal for the first data driver and a second input image signal for the second data driver; and outputting a corrected image signal, based on a first lookup table for storing a first correction value of the first input image signal for the first data driver based on a location of the first data driver with respect to a position on the display panel and a second lookup table for storing a second correction value of a second input image signal for the second data driver based on a location of the second data driver with respect to a position on the display panel, wherein the first and second correction values are set to different values so as to compensate for a difference between a charging rate of the first data lines by the first data driver and a charging rate of the second data lines by the second data driver.

12. The method of claim 11, wherein the outputting the corrected image signal includes:

generating the corrected image signal with respect to the first input image signal for the first data driver, based on the first lookup table; and generating the corrected image signal with respect to the second input image signal for the second data driver, based on the second lookup table.

13. The method of claim 11, wherein the first lookup table includes a plurality of first sub-lookup tables, and the second lookup table includes a plurality of second sub-lookup tables.

14. The method of claim 13, wherein the display panel is divided into N regions where N is a natural number, wherein the plurality of first sub-lookup tables and the plurality of second sub-lookup tables correspond to at least one of the N divided region regions of the display panel.

15. The method of claim 14, wherein the outputting the corrected image signal includes:

generating the corrected image signal with respect to the first input image signal with reference to a first sub-lookup table corresponding to a region to which a pixel to display the first input image signal belongs; and generating the corrected image signal with respect to the second input image signal with reference to a second sub-lookup table corresponding to a region to which a pixel to display the second input image signal belongs.

16. The method of claim 13, wherein the display device further includes pixels including a plurality of sub-pixels coupled to the plurality of data lines, the plurality of sub-pixels displaying images of different colors, wherein the plurality of first sub-lookup tables and the plurality of second sub-lookup tables respectively correspond to the plurality of sub-pixels.

17. The method of claim 11, wherein the corrected image signal is output further based on a third lookup table for storing a coefficient value applied to the first and second correction values of the first lookup table and the second lookup table.

18. The method of claim 17, wherein the outputting the corrected image signal includes:

generating the corrected image signal with respect to the first input image signal by multiplying the coefficient value by the first correction value of the first lookup table; and generating the corrected image signal with respect to the second input image signal by multiplying the coefficient value by the second correction value of the second lookup table.

19. The method of claim 17, wherein the display panel is divided into N regions where N is a natural number, wherein the third lookup table stores a plurality of coefficient values respectively corresponding to the N regions.

20. The method of claim 11, further comprising transferring data generated based on the corrected image signal to the first data driver and the second data driver, wherein the first data driver and the second data driver transfer a data voltage corresponding to the data as the data signal to the plurality of data lines.

* * * * *